US005561736A

United States Patent [19]

Moore et al.

[11] Patent Number: 5,561,736

[45] Date of Patent: Oct. 1, 1996

[54] THREE DIMENSIONAL SPEECH SYNTHESIS

[75] Inventors: Daniel J. Moore; Peter W. Farrett, both of Austin, Tex.

[73] Assignee: International Business Machines Corporation, Armonk, N.Y.

[21] Appl. No.: 73,365

[22] Filed: Jun. 4, 1993

[51] Int. Cl.[6] ..... G10L 5/02; G10L 9/00; G10L 3/00

[52] U.S. Cl. ..... 395/2.69; 395/2.81; 395/2.87; 395/2.86

[58] Field of Search ..... 395/2.67, 2, 2.86, 395/2.12, 2.79, 2.81, 2.87; 381/51, 52, 17

[56] References Cited

U.S. PATENT DOCUMENTS

| | | | |
|---|---|---|---|
| 4,251,687 | 2/1981 | Deutsch | 381/24 |
| 4,406,626 | 9/1983 | Anderson et al. | 395/2.79 |
| 4,831,654 | 5/1989 | Dick | 381/51 |
| 4,984,177 | 1/1991 | Rondel et al. | 395/2.86 |
| 5,181,247 | 1/1993 | Holl | 381/24 |
| 5,208,860 | 5/1993 | Lowe et al. | 381/17 |
| 5,220,629 | 6/1993 | Kosaka et al. | 381/52 |
| 5,255,326 | 10/1993 | Stevenson | 381/110 |
| 5,274,740 | 12/1993 | Davis et al. | 395/2.12 |
| 5,337,363 | 8/1994 | Platt | 381/17 |
| 5,384,851 | 1/1995 | Fujimori | 381/17 |

FOREIGN PATENT DOCUMENTS

| | | | |
|---|---|---|---|
| 0057854 | 8/1982 | European Pat. Off. | H04M 1/64 |
| 3205886A1 | 9/1983 | European Pat. Off. | H04M 1/64 |

OTHER PUBLICATIONS

Teleconferencing Using Stereo Voice and an Electronic OHP Nunokawa, IEEE Dec. 1988.

Audio–Enabled Graphical User Interface for The Blind or Visually Impaired McKiel Jr. IEEE/Feb. 1992.

*Primary Examiner*—Allen R. MacDonald
*Assistant Examiner*—Richemond Dorvil
*Attorney, Agent, or Firm*—Jeffrey S. LaBaw

[57] ABSTRACT

Method, product and system alters audio data for a synthesized voice so that when it is produced on a speaker system, it appears to emanate from a spatial position. First, the voice is synthesized into a speech waveform from a set of stored data representative of a text string using standard techniques. The speech waveform is converted into analog signals for a right and left channel. According to the invention, the analog signals to the right and left channels are altered according to position data stored with the text string so that the synthesized voice appears to originate at the apparent spatial position when the analog signals are sent to a speaker system.

22 Claims, 5 Drawing Sheets

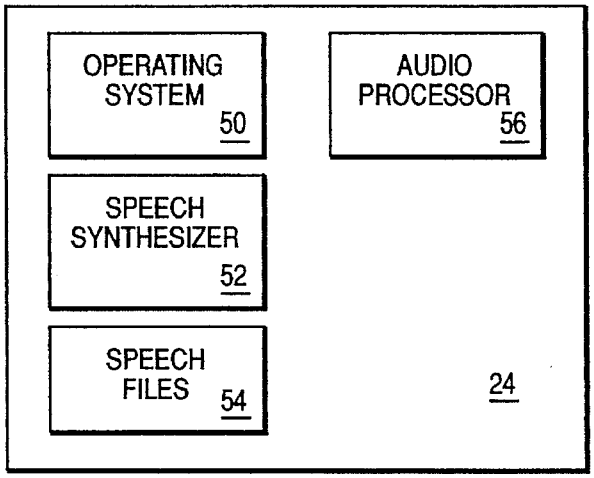
FIG. 3
POSITION TABLE
| POSITION | X, Y, Z | COMMENT |
|---|---|---|
| 1 | $X_1, Y_1, Z_1$ | 5' RIGHT |
| 2 | $X_2, Y_2, Z_2$ | 2' RIGHT |
| 3 | $X_3, Y_3, Z_3$ | CENTER |
| 4 | $X_4, Y_4, Z_4$ | 2' LEFT |
| 5 | $X_5, Y_5, Z_5$ | 5' LEFT |
FIG. 6A
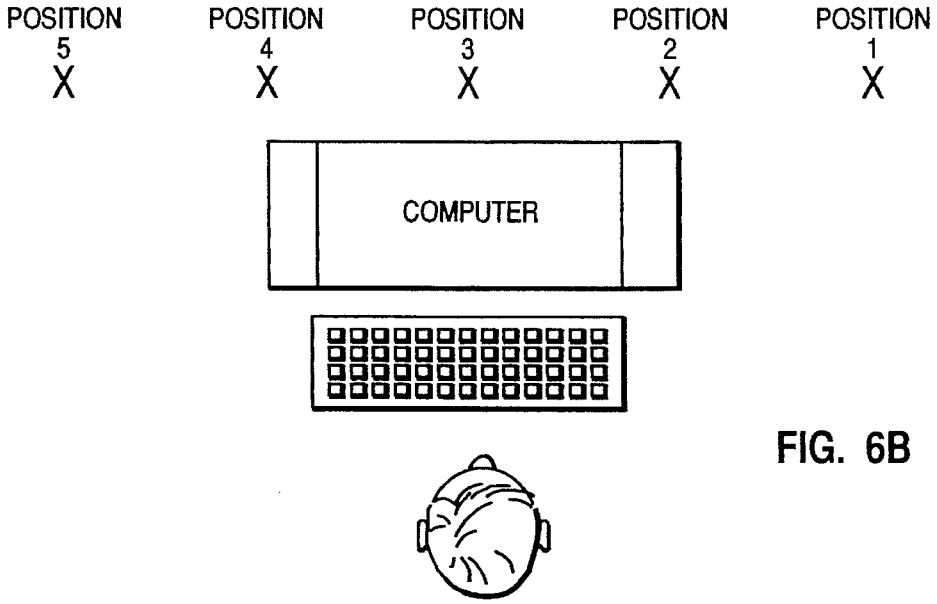
FIG. 6B

| | | | | |
|---|---|---|---|---|
| 100 | VOICE SYS 140 | POS=NEUTRAL 145 | DIA=0 151 | TEXT 1 155 |
| 102 | VOICE 1 141 | POS=1 146 | DIA=JAPANESE 152 | TEXT 2 |
| 104 | VOICE 2 142 | POS=3 148 | DIA=MIDWEST 153 | TEXT 3 157 |
| 106 | VOICE 3 143 | POS=5 150 | DIA=JAPANESE | TEXT 4 |
| 108 | VOICE 2 | POS=3 | DIA=MIDWEST | TEXT 5 |

| | | | | | |
|---|---|---|---|---|---|
| 110 | VOICE 1 | POS=1 | DIA=JAPANESE | SEMAN=! | TEXT 6 |
| 112 | VOICE 2 | POS=3 | DIA=MIDWEST | SEMAN=! | TEXT 7 |
| 114 | VOICE 4 144 | POS=4 149 | DIA=JAPANESE | SEMAN=? | TEXT 8 |
| 116 | VOICE 2 | POS=3 | DIA=MIDWEST | SEMAN=? | TEXT 9 |
| 118 | VOICE 4 | POS=4,3,2 | DIA=JAPANESE | SEMAN=? | TEXT 10 |
| 120 | VOICE 2 | POS=3 | DIA=MIDWEST | SEMAN=? | TEXT 11 |
| | . . . | | | | |
| 122 | VOICE 1 | POS=1 | DIA=JAPANESE | SEMAN=? | TEXT N |
| 124 | VOICE 2 | POS=3 | DIA=MIDWEST | SEMAN=? | TEXT N+1 |

| | | | | |
|---|---|---|---|---|
| 126 | VOICE 4 | POS=2 147 | DIA=JAPANESE | TEXT N+2 |
| 128 | VOICE 2 | POS=3 | DIA=MIDWEST | TEXT N+3 |

| | | | | |
|---|---|---|---|---|
| 134 | VOICE 4 | POS=1 | DIA=JAPANESE | TEXT N+6 |
| 136 | VOICE 2 | POS=3 | DIA=MIDWEST | TEXT N+7 |
| 138 | VOICE SYS | POS=0 | DIA=0 | TEXT N+8 |

FIG. 4

THREE DIMENSIONAL SPEECH SYNTHESIS

BACKGROUND OF THE INVENTION

This invention relates generally to sound reproduction and speech synthesis on a data processing system. More particularly, it relates to a method, program and system for speech synthesis in which spatial information is added to a synthesized voice.

While the visual images presented by the personal computers compatible with those built by the IBM Corporation have undergone a continual evolution of improvement, the typical speaker system of such a computer remains a single, inexpensive speaker buried somewhere in the system unit. The sound emanating from the speaker is of poor quality being unidirectional, fuzzy and difficult to discern. The personal computer has been regarded as an important agent of change in many areas of society, including education. Nonetheless, repetitive tasks, such as language drills, which are not regarded with universal enthusiasm on the part of students even in the best of classroom situations, become even less appealing in the acoustically impoverished environment generated by a typical computer.

Yet high quality sound reproduction for a personal computer has only recently been regarded as particularly important with the advent of multimedia. Although not yet equal to even inexpensive stereo systems, some multimedia computer systems use two external speakers for two channel "stereo" sound. While stereo sound will help add excitement and intelligibility to multimedia applications, further improvements in sound quality from the personal computer and its application programming are necessary to exploit the full potential of multimedia.

The stereo art teaches some lessons which have application to generating high quality sound from a computer. Indeed, many multimedia applications store conventionally recorded audio such as a sound track on a tape or CD. This is not surprising, as a considerable effort has already been devoted to stereo and there is little need to reinvent the wheel. Researchers have been steadily refining stereo technology since the 1930s when Alan Blumlein in U.S. Pat. No. 2,093,540 taught the basic precepts upon which much of the audio art is built. Despite the vast body of improvements to the stereophonic/art, it remains true that a conventional recording does not faithfully reproduce the spatial sound field of the original sound space and tends to produce a less satisfying listening experience than a live performance.

An appropriately programmed computer differs in many important respects and possesses many additional capabilities than the most elaborate stereo systems. One of the more important differences is that the user's interaction with a computer is much greater than with a stereo system. Thus, the actions taken by the computer will tend to vary much more depending upon the actions of the user. It is difficult to anticipate all the actions which a user might take and record all of the appropriate responses, although some of the interactive CD technologies appear to be taking this route. Further, unless a user has access to sophisticated sound recording equipment, he will be unable to modify the stored program to include an audio at the same fidelity of the original.

Speech synthesis or text-to-speech programming is well known. It can provide a flexible means of entering new information into a program as a user merely needs to type alphanumeric text via the system keyboard. In addition, storage of the alphanumeric information requires much less storage than the audio waveform of conventional stereo technology. To date, however, speech synthesis has not been entirely acceptable in terms of the audio quality generated, and because of this poor quality is not generally regarded as suitable for inclusion in a multimedia presentation. Whatever the shortcoming of conventional audio with regard to the accuracy with which directionality and spatial information is reproduced, synthesized speech has no spatial attributes and is especially dull and lifeless. The poor sound generated by present day speech synthesis is almost antithetical to a multimedia presentation. Thus, improvements in speech synthesis are necessary before they can be truly integrated with multimedia.

The present invention provides one improvement, a means for producing a more exciting multimedia application using synthesized voices, each of a plurality of voices appearing to originate from a different location in three dimensional space.

SUMMARY OF THE INVENTION

It is therefore an object of this invention to introduce spatial information to a synthesized voice.

It is another object of this invention to produce a plurality of synthesized voices which appear to originate at different spatial locations.

It is another object of this invention to produce the illusion of a three dimensional space.

These objects and others are accomplished by providing an apparent spatial position to a synthesized voice. The applicants propose introducing two or three dimensional (3D) spatial sound cues to a synthesized voice, thereby the synthesized voices appear more lifelike are easier to discern, and contain more information (via the spatial cues) than could be produced by monophonic sound single speaker. First, the voice is synthesized into a speech waveform from a set of stored data representative of a text string using standard techniques. Associated and stored with the text string is a set of position data related to the apparent position from which the voice synthesized from the text string will appear to originate. The speech waveform is converted into analog signals for a right and left channel. According to the invention, the analog signals to the right and left channels are altered according to the position data so that the synthesized voice appears to originate at the apparent spatial position when the analog signals are sent to a speaker system.

Typically, each text string is stored together with the spatial data which is used in the altering step to provide the apparent spatial position for that particular text string, although a stored default position could be used. A plurality of voices are associated with respective text strings, each voice may appear to originate at its own respective spatial position. Further, a dialect may be associated with the text string for which the stored, standard set of phonemes are altered, e.g., pitch and formant contours, to produce the chosen dialect.

The system can be equipped with a sensor to detect the user's position with respect to the computer system so that the apparent position of the synthesized voices remain constant irrespective of the user's position.

BRIEF DESCRIPTION OF THE DRAWINGS

These and other objects and features will become more easily understood by reference with the attached drawings and following description.

FIG. 3 illustrates a plurality of code modules running in memory according to the present invention.

FIG. 4 illustrates a set of messages to be synthesized according to the present invention.

FIG. 6A shows a position table giving the spatial coordinates, from which a plurality of synthesized voices appear to originate.

FIG. 6B shows a user seated in front of a computer system which generates the apparent positions for the synthesized voices.

DETAILED DESCRIPTION OF THE DRAWINGS

The invention can be implemented on a variety of computer platforms. The processor unit could be, for example, a personal computer, a mini computer or a mainframe computer, running the plurality of computer terminals. The computer may be a standalone system, part of a network, such as a local area network or wide area network or a larger teleprocessing system. Most preferably, however, the invention is described below is implemented on standalone multimedia personal computer, such as IBM's PS/2 series, although the specific choice of a computer is limited only by the memory and disk storage requirements of multimedia programming. For additional information on IBM's PS/2 series of computer readers referred to Technical Reference Manual Personal System/2 Model 50, 60 Systems and (IBM Corporation, Part Number 68X2224, Order Number S68X-2224 and Technical Reference Manual, Personal System/2 (Model 80) IBM Corporation, Part Number 68X22256, Order Number S68XS-2256.

Figure 1:
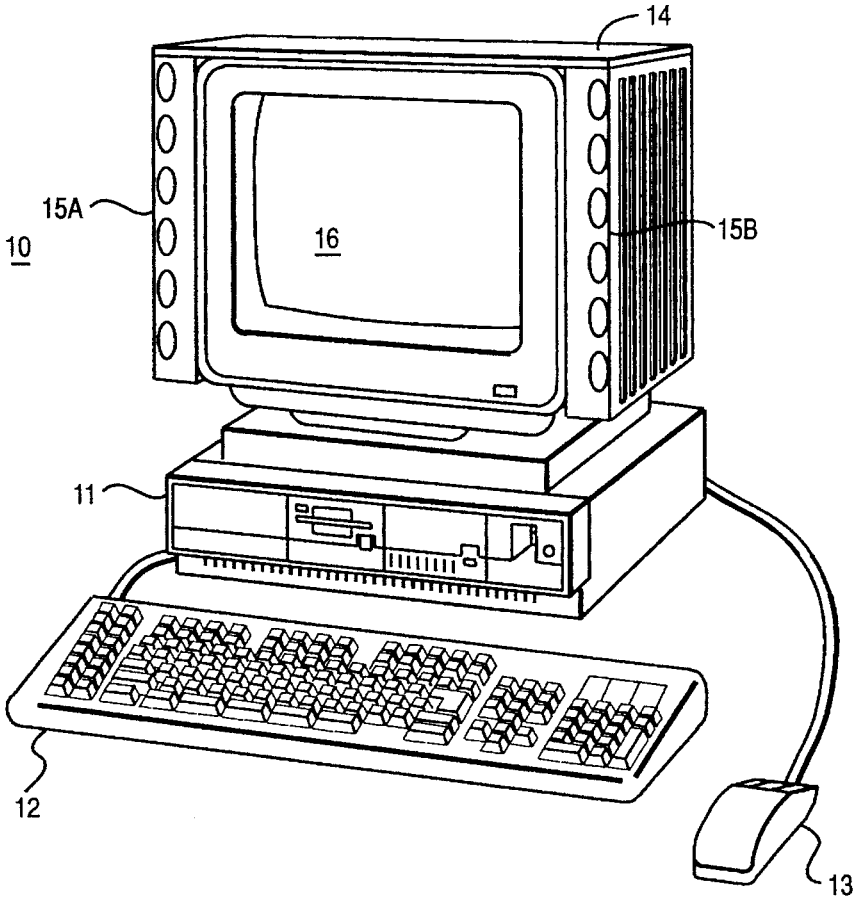
FIG. 1 is a representation of a multimedia personal computer system including the system unit, keyboard, mouse and multimedia equipment with speaker system.

In FIG. 1, a personal computer 10, comprising a system unit 11, a keyboard 12, a mouse 13 and a display 14. Also depicted are the speakers 15*a* and 15*b* mounted to the left and right of the monitor 14 as disclosed in copending application Ser. No. 07/969,677, "Personal Multimedia Speaker System", by A. D. Edgar filed Oct. 30, 1992, which is hereby incorporated by reference. The screen 16 of display device 14 is used to present the visual components of a multimedia presentation. While any pair of stereo speakers may be used in the present invention, those described in the incorporated application and below are particularly attractive. The speaker system 15*a* and 15*b* provides good quality sound with very good impulse and phase response with good directionality for the single listener without disturbing others nearby. Note that the very thin shape of the speaker system requires a minimum of additional desk space beyond that which would ordinarily be required by the display 14 itself.

Figure 2:
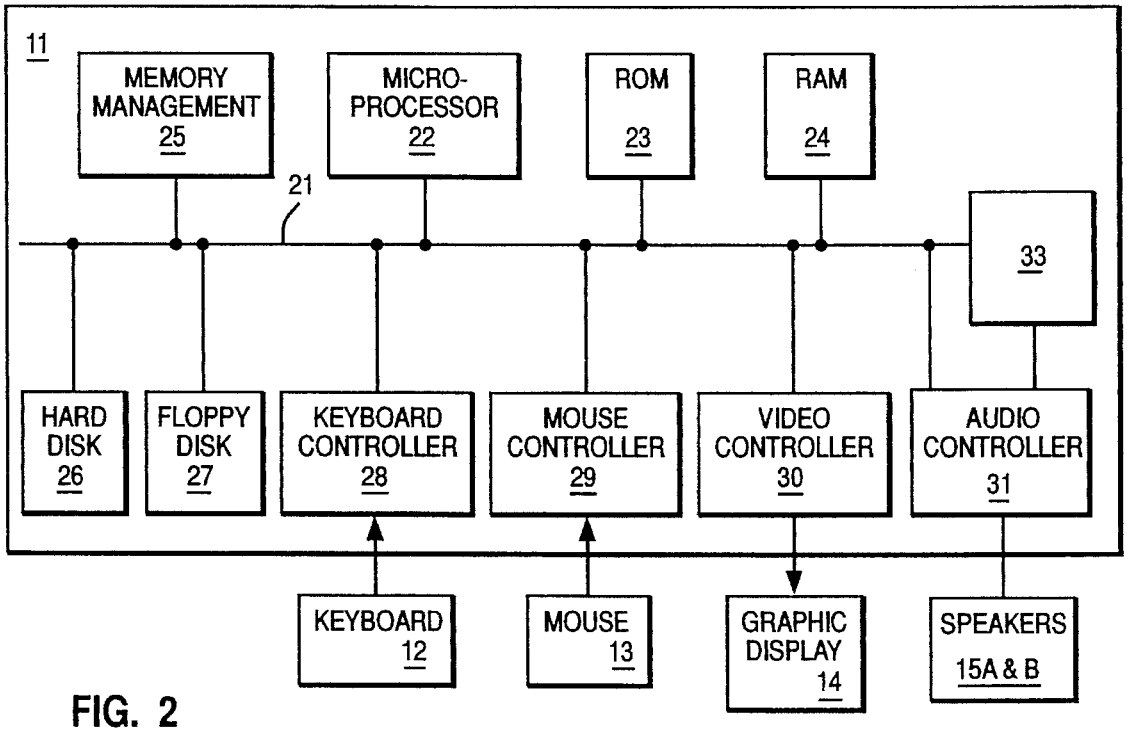
FIG. 2 is a block diagram of the multimedia computer system components.

FIG. 2 shows a block diagram of the components of the multimedia personal computer shown in FIG. 1. The system unit 11 includes a system bus or busses 21 to which various components are coupled and by which communication between the various components is accomplished. A microprocessor 22 is connected to the system bus 21 and is supported by read only memory (ROM) 23 and random access memory (RAM) 24 also connected to system bus 21. A microprocessor in the IBM multimedia PS/2 series of computers is one of the Intel family of microprocessors including the 8088, 286, 386 or 486 microprocessors, however, other microprocessors including, but not limited to Motorola's family of microprocessors such as the 68000, 68020 or the 68030 microprocessors and various Reduced Instruction Set Computer (RISC) microprocessors manufactured by IBM, Hewlett Packard, Sun, Intel, Motorola and others may be used in the specific computer.

The ROM 23 contains among other code the Basic Input/Output System (BIOS) which controls basic hardware operations such as the interaction and the disk drives and the keyboard. The RAM 24 is the main memory into which the operating system and multimedia application programs are loaded. The memory management chip 25 is connected to the system bus 21 and controls direct memory access operations including, passing data between the RAM 24 and hard disk drive 26 and floppy disk drive 27. A CD-ROM 28 also coupled to the system bus 21 is used to store the large amount of data present in a multimedia program or presentation.

Also connected to a system bus 21 are various I/O controllers: The keyboard controller 28, the mouse controller 29, the video controller 30, and the audio controller 31. As might be expected, the keyboard controller 28 provides the hardware interface for the keyboard 12, the mouse controller 29 provides the hardware interface for mouse 13, the video controller 30 is the hardware interface for the display 14, and the audio controller 31 is the hardware interface for the speakers 15*a* and 15*b*. Lastly, also coupled to the system bus is digital signal processor 33 which corrects the sound produced by the speaker system of the present invention to compensate for the small size of the speaker elements and is preferably in incorporated into the audio controller 31.

The figures shows a particular multimedia computer display 14 equipped with the left and right speaker systems 15*a* and 15*b* from the above referenced patent application. This particular speaker system provides stereo sound with good impulse and phase response and directionality for a single user seated in front of the display 14. Further, the speaker system also employs a sonic ranging technique to locate the user with respect to the display by using at least two speakers that emit sound energy and/or act as microphones to receive the reflected sound from the head of the user. The circuitry supporting the system measures the time delay to determine the distance of the user from the display. With at least two sets of distances based on two emitters or two receivers, the use of triangulation techniques locates the user' position in the XY plane. A third input from a third speaker microphone pair can be used to locate a user in the Z dimension, if desired. Thus, the sonic mouse enables the stereo system to locate the user in the room. The "sweet spot" on which stereo techniques such as sonic holography and spectral cues rely can be adjusted to meet the user wherever he has positioned himself in the room. However, as mentioned previously any quality speaker system may be employed to accomplish the principles of the present invention.

FIG. 3 depicts the code modules resident in the random access memory 24 which would be necessary to carry out the present invention. Until they are needed, these modules could be stored in another removable computer memory such as a floppy disk for the floppy disk drive or an optical disk for the CD ROM or in hard disk storage. Operating system 50 controls the interaction of the various software modules with the hardware comprising the computer system. It also controls the user interface with which the user interacts. Speech synthesizer 52 produces the synthesized speech according to one or more speech files 54. While the speech synthesizer could be based on any of the current speech synthesis technologies and altered according to the principles of the present invention, a particularly preferred speech synthesizer is described in Ser. No. 07/976,151"Synthesis and Analysis of Dialects" filed to P. Farrett filed Nov. 13, 1992 which is hereby incorporated by reference. This synthesizer is preferred as it efficiently synthesizes speech in a plurality of dialects concurrently. The synthesizer changes the intonational contour of the fundamental pitch of a string of concatenated speech waveforms each of which corresponds to a phoneme in the text, depending on a set of intervals characteristic of a particular dialect. While the source of the speech file 54 could be an input across an I/O adapter on a local area network or from a system keyboard, it is preferred that the speech files be stored locally on magnetic or CD-ROM optical disk storage. The audio processor 56 is used to provide the stereo effects of the present invention.

The present invention envisions a plurality of voices each of which is associated with one or more text strings in a speech file. Each voice would appear to originate at a particular spatial location. Thus, each speech string is stored with data for a voice and a desired position in the speech file. The audio controller 56 takes the position information to add the spatial cues which are ordinarily missing from synthesized speech.

In Table 1 and FIG. 4, a sample language lesson is depicted with which the present invention might be utilized. This lesson is designed to illustrate many of the features of the invention. A typical language lesson using the single speaker of the system unit could become quite tedious. With the present invention, the position of each voice is identifiable and the conversation seems to bounce from position to position making it much more exciting and interesting.

A plurality of text strings 100 through 138 each associated with variables for a voice, a position and a dialect correspond to lines in Table 1. The number in parenthesis corresponds to the line in the figure. For example, in Table 1, "System Atonal (100): Lesson 12: Ordering Breakfast" corresponds to line 100 in FIG. 4. The dialog includes variables for five different voices: the mechanical voice of the system 140, Mr. Tanaka's voice 141, the interpreter's voice 142, Mrs. Tanaka's voice 143 and the waiter's voice 144. Obviously, a greater or smaller number of voices can be supported by the present invention, limited only by the storage and processing capabilities of the computer system.

There are also values, for six different positions in the dialog, the neutral position of the system and from right to left, position 1 from which Mr. Tanaka speaks, position 2 which is used briefly by the waiter, position 3 which is the center position and is used by the interpreter, position 4 which is also used by the waiter as he moves about the table and position 5 where Mrs. Tanaka speaks.

Each of positions, one to five, is associated with a particular X, Y, Z coordinate from which the system will cause the associated voice to originate. While a plurality of stereo techniques are known to the prior art, nearly all involve changing phase and intensity values for the right and left channels dependant upon the frequency of the sound to be produced by the speaker. More detail on one preferred embodiment is given below. Three dialects are used: The first "dialect" is the system voice which uses a voice/or speech waveform synthesized from the unmodified phoneme string. None of the intonational intervals which add dialect meaning are applied for the system voice. In this case, the dialog variable 151 for the first phoneme string is set to zero. The end result is a very mechanical sounding voice which provides a contrast to the lively characters in the dialog. The second "dialect", in this case a language, is Japanese and the dialect variable 152 to the second phoneme string is set to Japanese. The third dialect is in a Mid-Western accent 153 in English for the interpreter; the dialect variable for the third string, for example, is set to Mid-Western. For the Japanese and Mid-West dialects, dialect characteristics such as intonational intervals are retrieved which are particular to that respective dialect and applied to a basic stored phoneme string from which the various dialects are derived. In alternative systems, a complete set of phonemes for each dialect may be stored. Further, the present invention will work acceptably without specific dialect information.

Text strings 100 through 138 also include text blocks 1 through N+8 each of which contains the necessary text-based information for one of the text lines in Table 1. For example, the text block 1 designates 155 in the figure corresponds to "Lesson 12: Ordering Breakfast", as the text block 3 designated as 157 in the figure corresponds to "You must be hungry". The dialog continues alternating between the Japanese characters and the English translation, until text string line 138, containing text block N+8, for the system to announce "End of Lesson. Please press enter for next lesson."

TABLE 1

| | |
|---|---|
| System[100]: | Lesson Twelve: Ordering Breakfast |
| Mr. Tanaka[102]: | Onaka ga suitadaroo. |
| English[104]: | You must be hungry. |
| Mrs. Tanaka[106]: | Kono hoteru ni wa ii resutoran gaarusoo kara soko e itte mimashoo. |
| E[108]: | They say there is a good restaurant in this hotel. Let's have a breakfast there. |
| Mr. Tanaka[110]: | Sumimasen. |
| E[112] | Excuse me. |
| Waiter[114]: | Oyobi de gozaimasu ka? |
| E[116]: | (Yes) You called sir? |
| Mrs. Tanaka: | Chooshoku to tabetai n desu ga. Nani gaitadakemasu ka? |
| E: | We would like breakfast. What can we have? |
| Waiter[118]: | Roorupan ni toosuto, sorekara hotto keeki mo dekimasu. Onomimono wa koohii, koocha, hotto chokoreeto ga gozaimasu. Nan niitashimashoo ka? |
| E:[120] | Rolls, toast and hot cakes too. As for drinks, coffee, tea or hot chocolate. What would you like to have? |
| Mr. Tanaka[122] | Sumimasen. Okanjoo o onegai dekimasu ka? |
| E[124]: | Excuse me. May I have the check please? |
| Waiter[126]: | Kashikomarimashita. |
| E[128]: | (Yes) Certainly sir. |
| Waiter[134]: | Omatase itashimashita. Doo mo arigatoo gozaimashita. |
| E[136): | Sorry to have kept you waiting. Thank |

TABLE 1-continued

| | |
|---|---|
| | you very much. |
| System:[138] | End of Lesson. Please press enter for next lesson. |

Figure 5:
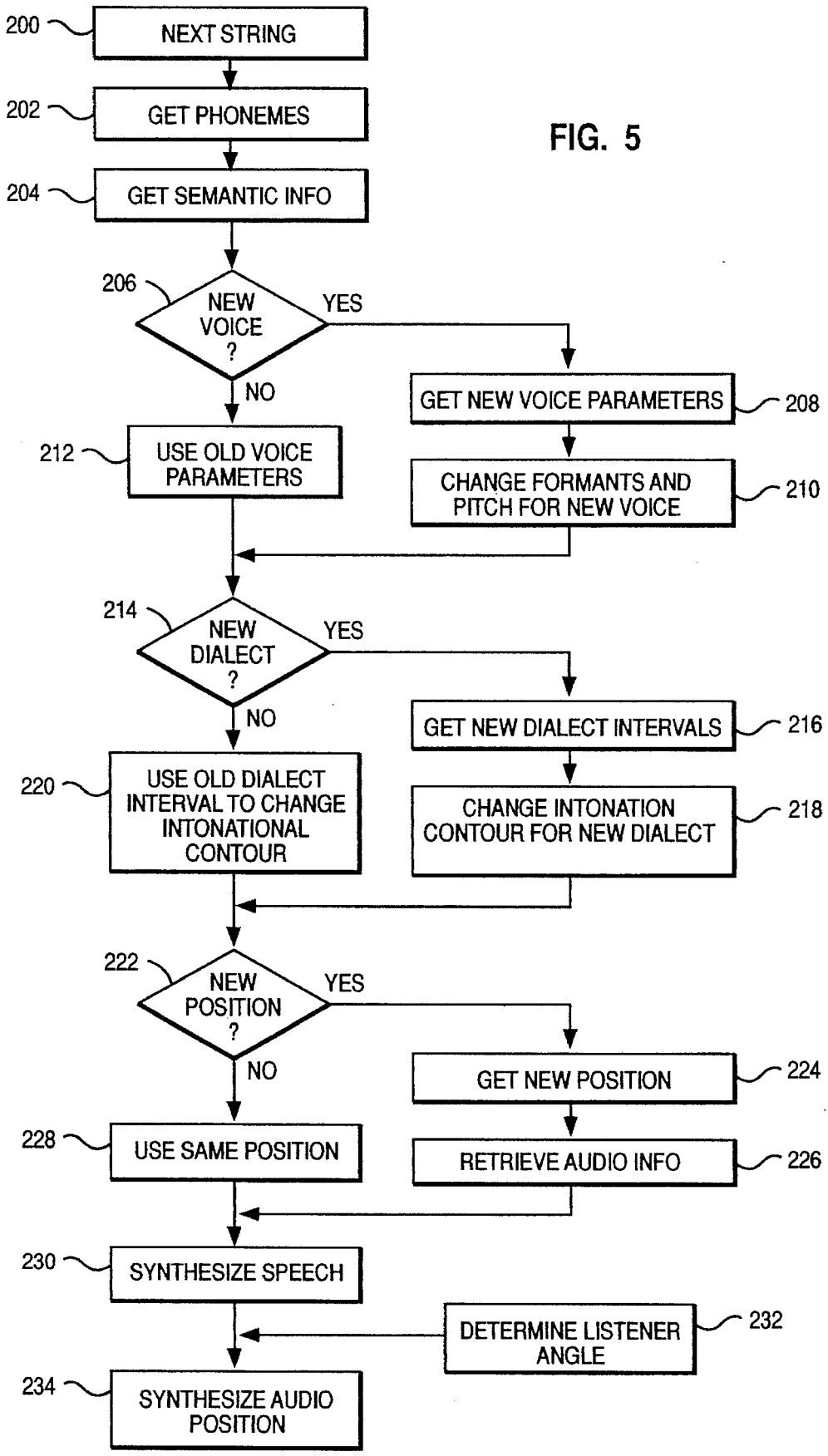
FIG. 5 illustrates a flow diagram of synthesizing speech with spatial information.

The method of operation of the speech system is depicted in the flow diagram of FIG. 5. In step 200, the next text string is retrieved. The phonemes or other linguistic units which are associated with the text string are retrieved and sequentially concatenated in step 202. In step 204, semantic information relating to punctuation is retrieved such as exclamations or questions can be provided with a dialog. If no semantic information is provided, the system would assume a default semantic context such as a statement. The intonational contour and timing of the phonemes are altered appropriately according to the semantic information, Next, in step 206, a test is performed to determine whether this text string is associated with a new voice. If so, in step 208, the new voice parameters associated with the voice are retrieved. For example, the formant and pitch characteristics for a female voice differ substantially from those of a male voice. In step 210, the retrieved voice parameters are applied to the phoneme string to alter it according to the new voice. In other more storage intensive speech systems, separate phoneme sets may be stored for each voice. If it is not a new voice, in step 212, the old voice parameters are applied to the phoneme string.

Next, in step 214, a test is performed to determine whether a new dialect, is associated with this text string. If so, in one preferred embodiment, the dialect intervals associated with the new dialect are retrieved from a table in step 216. Next, in step 218, the intonational contour of the concatenated phonemes is changed according to these dialect intervals. If it is not a new dialect, in step 220, the old dialect intervals are used to change the intonational contour. Again, in more storage intensive speech systems, separate phonemes sets could be used for each dialect.

In step 222, a test is performed to determine whether this text string is associated with a new position. If so, the new position is retrieved in step 224 and the audio information associated with the position is retrieved in step 226. If it is not a new position, the system assumes that it is the same position and in step 228 passes it to the speech and audio synthesizers.

In step 230, the phonemes, semantic information, voice and dialect information are used to produce a synthesized speech waveform. The synthesized waveform and position information are passed to the audio processor module. Next, in step 232, the listener angle is determined. The listener angle can be determined by the sonic mouse mode of the speaker system as described above or it can be set by the user in a user interface associated with the speech system. A default listener angle can also be used. Next, in step 234, the position and audio information associated with that position and listener angle are used by the audio processor to add spatial information to the synthesized speech waveform so that this text string can appear to originate from a particular location. While the voices in lesson are sequential, the invention may be used to produce concurrently generated voices, each speaking at the same time from its own respective position.

In FIG. 6A, the position table is depicted, in FIG. 6B a user seated in front of a computer system and the apparent positions are illustrated. For each position, a set of X, Y, Z coordinates are stored. The audio processor uses the X, Y, Z coordinates to produce the apparent positions of the synthesized speech. Comments are provided in the table so that a user or developer might understand where the apparent position of a particular set of coordinates would be relative to the display screen. In FIGS. 6A and 6B, the positions correspond to the conversation illustrated above. However, a far greater number of positions can be accommodated according to the present invention. Also, the invention can include positions appearing to come from the ceiling or floor along the Z axis.

Referring also to the language lesson illustrated above, the first line of the dialog is text string 100 in FIG. 4, using the voice of the system. The system voice is a mechanical voice which does not use any spatial or dialect information. The voice will sound very machine-like and flat. However, it provides a useful contrast to the highly animated and spatially positioned voices in the rest of the dialog. Next, Mr. Tanaka speaks in Japanese at position 1, five feet to the right of the screen. The English translation follows in a Mid-Western English dialect at position 3, screen center. Mrs. Tanaka replies in Japanese at position 5, five feet to the left of the screen. Mrs. Tanaka's voice is also pitched higher with formants appropriate to a female speaker. Next, the English translation associated with the string 108 follows at screen center.

Associated with text string 118, another feature of the invention is shown, as the waiter appears to move around the table from position 4, two feet to the left of the screen, to position 3, center screen, and finally to position 2, two feet to the right of the screen. This motion could appear continuous as the system interpolates positions between position 4 and 2. Alternatively, the voice may simply switch from position 4, to position 3 and then to position 2. In text string 138, the system voice announces that the lesson is over, again in its position neutral dialect neutral, machine-like, voice.

Although there are many techniques existing in the prior art to create a stereo or "three-dimensional" sound effect, one of the best is disclosed in U.S. Pat. No. 5,046,097, entitled "Sound Imaging Process" to Lowe et al, issued Sep. 3, 1991 and hereby incorporated by reference. This patent also has an excellent background section of other prior art techniques. The technique described in the U.S. Pat. No. 5,046,097 patent translates the position specified by the user into a left and right complex frequency transfer function which alters the amplitude and shifts the phase of the left and right channels. Shifting the phase is roughly equivalent to a specific time delay between channels. The amount of the amplitude and phase shifts vary across the audio spectrum according to the frequency of the input signal. Although the general technique is presaged by Blumlein in U.S. Pat No. 2,093,540, at least one of the channels is passed through a filter having a frequency response characterized by transfer function:

$$T(S)=(1-(1/R_1)(R_1-R_2)/(1-SCR_3)$$

where S is the LoPlace complex frequency variable, $R_1$ and $R_2$ are the input and feedback impedances connected to an inventing input to an amplifier section of the filter, C and $R_3$ are the input and ground elements connected to a noninverting input to the amplifier section. The patent also envisions a system in which the position is chosen by the user contemporaneously with hearing the sound of the speaker. In this embodiment, no position data is stored per se, only the altered audio signals to the right and left channels.

Figure 7:
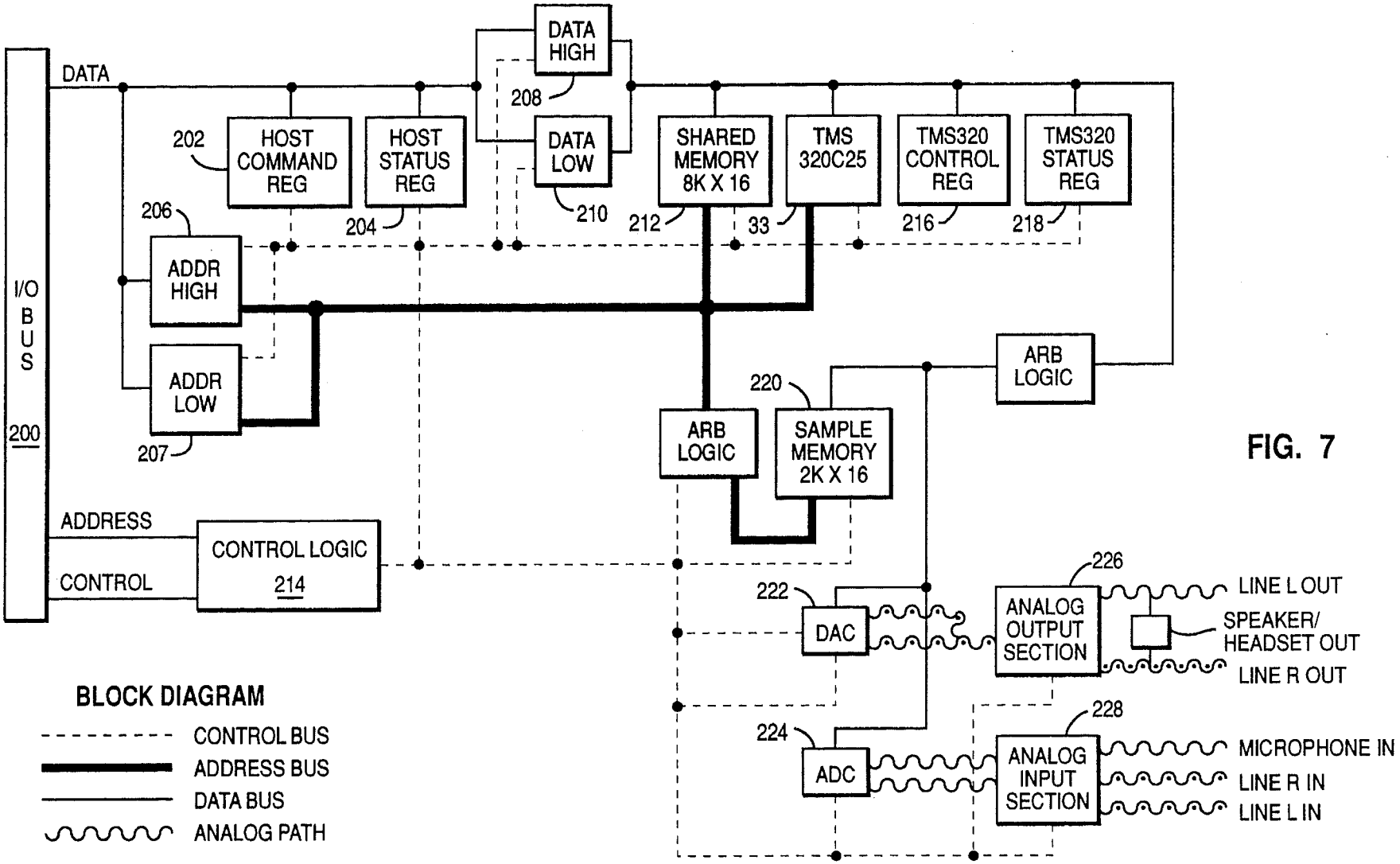
FIG. 7 depicts an audio controller card which can be used to assist the main process of the computer to control the speakers and provide the spatial information to a synthesized voice according to the present invention.

FIG. 7 depicts an exemplary audio controller card which includes a digital signal processor (DSP) for the correction of the speaker response. The audio controller is the M-Audio Capture and Playback Adapter announced and shipped on Sep. 18, 1990 by the IBM Corporation. Those skilled in the art would recognize that many other sounds could be used. Referring to FIG. 7, the I/O bus 200 is a microchannel or PC I/O bus which allows the audio controller. The personal computer passes information via the I/O bus 200 to the audio controller employing a command register 202, a status register 204 and an address high byte counter 206 and an address low byte counter 207, a high data high byte bidirectional latch 208, and a data low bidirectional latch 210. These registers are used by the host to issue commands and monitor the status of the audio controller card. The address and data latches are used by the personal computer to access the shared memory 212, which is an 8K by 16 bit static RAM on the audio controller card. The shared memory 212 also provides a means of communication between the personal computer and the digital signal processor 33.

A memory arbiter, part of the control logic 214, prevents the personal computer and the DSP 33 from accessing the shared memory 212 at the same time. A shared memory 212 can be divided so that part of the information is logic used to control the digital signal processor 33, the digital signal processor has its on control registers 216 and status registers 218 for issuing commands and monitoring the status of other parts of the audio controller card. The audio controller card contains another block of RAM called the sample memory 220. The sample memory 220 is a 2K by 16 bit static RAM which the DSP 33 uses for outgoing audio signals to be played on these speakers systems or incoming signals of digitized audio for transfer to the personal computer for storage. For example, the sonic mouse mode both emits sound and receives the reflected sound back to determine listener angle. Also, a microphone or tape player can be attached to the card. The digital analog converter (DAC) 222 and the analog digital converter (ADC) 224, convert the audio signal between the digital environment of the computer and the analog sound produced by the speakers or received by the microphone. The DAC 222 receives digital samples from the sample memory 220 converts the samples to analog signals and send these signals to the analog output section 226. The analog output section 226 conditions and sends the signals to the output connectors for transmission via the speaker system. As the DAC 222 is multiplexed continuously, stereo operation can be given to both speaker components.

The ADC is the counterpart of the DAC 222. The ADC 224 receives analog signals from the analog input section 228 which receive the signals from the speaker system acting as a microphone or other audio input device such as a tape player. The ADC 224 converts the analog signals to digital samples and stores them in the sample memory 220. The control object 214 issues interrupts to the personal computer after the DSP 33 has issued an interrupt request.

Providing a stereo audio signal to the speaker system works in the following way. The personal computer informs the DSP 33 that the audio controller should play a particular sample of digitized sound data. In the subject invention, the personal computer gets code for control of the DSP 33 and the digital audio samples from its memory transfers them to the shared memory 212 through the I/O bus 200, the DSP 33 takes the samples and converts them to integer representations of logarithmically mixed scale values and places them in the sample memory 220. This step is now repeated for each synthesized voice that is to be produced concurrently with the original voice. The final result in sample memory 220 is the digital audio summation of all synthesized voices, each with their spatial placement maintained. The DSP 33 then actives the DSC 222 which converts the digitized samples into audio signals, the audio output section 226 conditions the audio signals and places them on the output connectors.

To operate in a sonic mouse mode, the personal computer system works in the following manner. After emitting a sound as described above, the personal computer informs the digital signal processor 33 through the I/O bus 200 that the audio controller card should digitize an incoming audio signal. The DSP 33 uses its control registers 216 to enable the ADC 224. The ADC 224 digitizes the incoming audio signals and places the samples in the sample memory 220. The DSP 33 receives the signal from the sample memory 220 and transfers them to the shared memory 212, the DSP 33 then informs the personal computer via the I/O bus 200 that the digital samples are ready for the personal computer processor to read. The personal computer gets the samples over the I/O bus 200, interprets and, stores them in the host RAM or disk storage.

While the invention has been described with respect to particular embodiments above, it would be understood by those skilled in the art that modifications may be made without parting from the spirit and scope of the present invention. For example, rather then a language lesson, the invention may be used to generate messages in a different audio plane from its messages, making it easier for a user to discern warning from normal audio. These embodiments are purposes of example and illustration only and are not to be taken to limit the scope of the invention narrower than the scope of the appended claims.

We claim:

1. A method for providing an apparent spatial position to speech synthesis by a computer system, comprising the steps of:

storing a speech file containing text and position data in a computer memory;

synthesizing a speech waveform from the text data in the speech file, the speech waveform being of a synthesized human voice reciting words contained in the text data;

converting the speech waveform into analog signals for a right and a left channel; and altering the analog signals according to the position data in the speech file so that the synthesized voice appears to originate at the apparent spatial position when the analog signals are sent to a speaker system.

2. The method as directed in claim 1 wherein the speech file contains a plurality of text strings each of which is associated with a respective set of position data, and the synthesizing, converting and altering steps are repeated for each of the text strings so that each of a plurality of synthesized human voices appears to originate at a respective spatial position when the analog signals are sent to the speaker system.

3. The method as recited in claim 1 wherein the speech file also contains dialect data and further comprises the step of first altering the speech waveform synthesized from the text data according to the dialect data prior to conversion to the analog signals so that the synthesized human voice appears to speak in a dialect indicated by the dialect data when the analog signals are sent to the speaker system.

4. The method as recited in claim 1 wherein the speech file contains a plurality of text strings each of which is associated with a respective set of position data and dialect data, and the synthesizing, converting and altering steps are repeated for each of the text strings, and further comprises the step of first altering each speech waveform synthesized from each text string according to the respective set of dialect data prior to conversion to analog signals so that each of a plurality of synthesized human voices appears to originate at a respective spatial position in a respective dialect when the analog signals are sent to the speaker system.

5. The method as recited in claim 1 which further comprises the step of determining a listener position with respect to the speaker system, wherein the altering step is carried out according to the listener position.

6. The method as recited in claim 5 wherein the determining step is accomplished by detecting the listener position with a sensor coupled to the computer system.

7. The method as recited in claim 5 wherein the determining step is performed according to user input to a user interface presented by the computer system.

8. A system for providing an apparent spatial position to, speech synthesis comprising:

means for storing a speech file containing text and position data in a computer memory;

means for synthesizing a speech waveform from the text data in the speech file, the speech waveform being of a synthesized human voice reciting words contained in the text data;

means for converting the speech waveform into analog signals for a right and a left channel; and means for altering the analog signals according to the position data in the speech file so that the synthesized voice appears to originate at the apparent spatial position when the analog signals are sent to a speaker system.

9. The system as recited in claim 8 wherein the speech file contains a plurality of text strings each of which is associated with a respective set of position data, and the synthesizing, converting and altering means are employed for each of the text strings so that each of a plurality of synthesized human voices appears to originate at a respective spatial position when the analog signals are sent to the speaker system.

10. The system as recited in claim 9, wherein the system is a multimedia computer system which processes the speech file as part of a multimedia presentation in which the plurality of synthesized human voices participate in a dialog stored as the text data in the speech file.

11. The system as recited in claim 9 further comprising:

means of distinguishing text data from position data in the speech file;

means for sending the text data to the synthesizing means; and means for sending the position data to the altering means.

12. The system as recited in claim 8 wherein the speech file also contains dialect data and further comprises means for altering the speech waveform synthesized from the text data according to the dialect data prior to conversion to the analog signals so that the synthesized human voice appears to speak in a dialect indicated by the dialect data when the analog signals are sent to the speaker system.

13. The system as recited in claim 8 wherein the speech file contains a plurality of text strings each of which is associated with a respective set of position data and dialect data, and the synthesizing, converting and altering means are employed for each of the text strings, and further comprises means for altering each speech waveform synthesized from each text string according to the respective set of dialect data prior to conversion to analog signals so that each of a plurality of synthesized human voices appears to originate at a respective spatial position in a respective dialect when the analog signals are sent to the speaker system.

14. The system as recited in claim 13, wherein the system is multimedia computer system which processes the speech file as part of a language lesson in which the plurality of synthesized human voices participate in a dialog in a variety of languages as stored in the text data in the speech file.

15. The system as recited in claim 8 which further comprises means for determining a listener position with respect to the speaker system, wherein the altering means alters the analog signals according to the listener position.

16. The system as recited in claim 15 wherein the determining means includes a sensor coupled to the computer system which detects the listener position.

17. The system as recited in claim 15 wherein the determining means is a user interface presented by the computer system in which a user listener position may be input.

18. The product as recited in claim 8 which further comprises means for determining a listener position with respect to the speaker system, wherein the altering means alters the analog signals according to the user position.

19. A computer program product resident in a computer readable memory for providing an apparent spatial position to speech synthesis performed by a computer system, comprising:

means for storing a speech file containing text and position data on a computer readable medium;

means for synthesizing a speech waveform from the text data in the speech file, the speech waveform being of a synthesized human voice reciting words contained in the text data;

means for converting the speech waveform into analog signals for a right and a left channel; and means for altering the analog signals according to the position data in the speech file so that the synthesized voice appears to originate at the apparent spatial position when the analog signal are sent to a speaker system.

20. The product as recited in claim 19 wherein the speech file contains a plurality of text strings each of which is associated with a respective set of position data, and the synthesizing, converting and altering means are employed for each of the text strings so that each of a plurality of synthesized human voices appears to originate at a respective spatial position when the analog signals are sent to the speaker system.

21. The product as recited in claim 19 wherein the speech file also contains dialect data and further comprises means for altering the speech waveform synthesized from the text data according to the dialect data prior to conversion to the analog signals so that the synthesized human voice appears to speak in a dialect indicated by the dialect data when the analog signals are sent to the speaker system.

22. The product as recited in claim 19 wherein the speech file contains a plurality of text strings each of which is associated with a respective set of position data and dialect data, and the synthesizing, converting and altering means are employed for each of the text strings, and further comprises means for altering each speech waveform synthesized from each text string according to the respective set of dialect data prior to conversion to analog signals so that each of a plurality of synthesized human voices appears to originate at a respective spatial position in a respective dialect when the analog signals are sent to the speaker system.

* * * * *